US008980811B2

(12) United States Patent
Boccaletti et al.

(10) Patent No.: US 8,980,811 B2
(45) Date of Patent: Mar. 17, 2015

(54) METHOD FOR LUBRICATING WIND TURBINE GEARBOX

(75) Inventors: Giovanni Boccaletti, Roncoferraro (IT); Fabio Riganti, Carnago (IT); Manfred Jungk, Geisenheim (DE)

(73) Assignee: Solvay Solexis S.p.A., Bollate (IT)

( * ) Notice: Subject to any disclaimer, the term of this patent is extended or adjusted under 35 U.S.C. 154(b) by 489 days.

(21) Appl. No.: 12/992,292

(22) PCT Filed: May 15, 2009

(86) PCT No.: PCT/EP2009/055946

§ 371 (c)(1),
(2), (4) Date: Nov. 12, 2010

(87) PCT Pub. No.: WO2009/141284

PCT Pub. Date: Nov. 26, 2009

(65) Prior Publication Data

US 2011/0067957 A1 Mar. 24, 2011

(30) Foreign Application Priority Data

May 20, 2008 (EP) ..... 08156520

(51) Int. Cl.
*C10M 107/38* (2006.01)
*C10M 125/24* (2006.01)
*C10M 169/04* (2006.01)

(52) U.S. Cl.
CPC ..... *C10M 107/38* (2013.01); *C10M 169/04* (2013.01); *C10M 2211/06* (2013.01); *C10M 2213/0606* (2013.01); *C10M 2223/08* (2013.01); *C10M 2225/00* (2013.01); *C10N 2220/022* (2013.01); *C10N 2230/06* (2013.01); *C10N 2230/10* (2013.01); *C10N 2240/04* (2013.01)
USPC ..... 508/582; 508/422

(58) Field of Classification Search
USPC ..... 508/422, 582
See application file for complete search history.

(56) References Cited

U.S. PATENT DOCUMENTS

| | | | | |
|---|---|---|---|---|
| 3,214,478 | A | 10/1965 | Milian | |
| 3,242,218 | A | 3/1966 | Miller | |
| 3,665,041 | A | 5/1972 | Sianesi et al. | |
| 3,715,378 | A | 2/1973 | Belardinelli et al. | |
| 4,523,039 | A | 6/1985 | Lagow et al. | |
| 2005/0090410 | A1 * | 4/2005 | Devlin et al. | 508/438 |
| 2005/0187116 | A1 * | 8/2005 | Russo et al. | 508/422 |
| 2007/0197339 | A1 * | 8/2007 | Ryymin et al. | 475/331 |
| 2008/0032904 | A1 | 2/2008 | Watanabe et al. | |

FOREIGN PATENT DOCUMENTS

| | | | |
|---|---|---|---|
| CA | 786877 | A | 6/1968 |
| CN | 1829586 | A | 9/2006 |
| EP | 148482 | A2 | 7/1985 |
| EP | 1336614 | A1 | 8/2003 |
| EP | 1873162 | A1 * | 1/2008 |
| GB | 1226566 | A | 3/1971 |
| WO | WO 8700538 | A1 | 1/1987 |
| WO | WO 2004/108356 | A1 | 12/2004 |
| WO | WO 2006/090641 | A1 | 8/2006 |
| WO | WO 2008000706 | A1 | 1/2008 |

OTHER PUBLICATIONS

Errichello R., et al, "New Guidelines for Wind Turbine Gearboxes", Gear Technology, 1998, 0501, vol. 15, No. 3, p. 15-20, XP000767794, Randall Publishing Co., Elk Grove, Illinois, US; 6 pgs.

Errichello R., et al, "Oil Cleanliness in Wind Turbine Gearboxes", Machinery Lubrication Magazine, Jul. 2002; 6 pgs.

Maccone P. et al., "New Additives for Fluorinated Lubricants", 70th NLGI Annual Meeting, Hilton Head Island, South Carolina (Oct. 25-29, 2003), No. #0318, 11 pgs.

Press release entitled "Increases in wind turbine performance mean the lubricant assumes an ever-greater importance, it is a major element in the tribological system to be considered in the design of wind power stations" from Kluber Lubrication GB, published on Engineering talk (www.engineeringtalk.com) on Jun. 12, 2006, 3 pgs.

Chinese Office Action issued Jul. 30, 2013, in counterpart Chinese Patent Application No. 200980118414.1 (18 pp including English translation.).

Mock, George, "Selecting the Right PFPE Lubricant," Gear Solutions, Mar. 2008, pp. 34-37.

* cited by examiner

*Primary Examiner* — James Goloboy
(74) *Attorney, Agent, or Firm* — Arent Fox LLP

(57) ABSTRACT

A method of lubricating a wind turbine gearbox comprising using a lubricating composition comprising at least one (i.e. one or a mixture of more than one) perfluoropolyether (PFPE) lubricant which comprises a perfluorooxyalkylene chain, said perfluorooxyalkylene chain comprising recurring units having at least one ether bond and at least one fluorocarbon moiety. A wind turbine gearbox comprising a lubricating system containing said lubricating composition.

9 Claims, No Drawings

METHOD FOR LUBRICATING WIND TURBINE GEARBOX

CROSS-REFERENCE TO RELATED APPLICATIONS

The present patent application is a U.S. national stage application under 35 U.S.C. §371 of International Application No. PCT/EP2009/055946, filed May 15, 2009, which claims the benefit of the European patent application No. 08156520.2, filed on May 20, 2008, the whole content of this application being incorporated herein by reference for all purposes.

TECHNICAL FIELD

The invention pertains to an improved method for lubricating the gearbox or speed-increasing unit in a wind turbine and a wind turbine gearbox.

BACKGROUND ART

Air power wind turbines or wind mills are complex energy conversion systems that harnesses wind as a power source for the production of electricity, which are today increasingly attracting more interest as an alternative renewable source of energy.

Said wind-electric turbine generators, also known as wind turbines, are basically composed of a rotor consisting of one or more blades that convert wind energy into rotational/mechanical energy. As the air flows past the rotor of a wind turbine, the rotor spins and drives the shaft of an electric generator to produce electricity. As the nature of aerodynamics generally limits the speed of rotor to levels below that required by standard generators, a speed increasing gearbox is generally required for operating economically the turbine.

Thus, a gear-box is typically placed between the rotor of the wind turbine blade(s) and the rotor(s) of generator(s). More specifically, the gear-box connects a low-speed shaft turned by the wind turbine blade(s) rotor at about 10 to 30 rotations per minute (rpm), generally about 15-20 rpm to one or more than one high speed shaft that drives the generator to increase the rotational speed up to about 1000 to 2000 rpm, the rotational speed required by most generators to produce electricity.

The evidently high torque can generate huge stress on the gears and bearings in the geared wind turbine. Wind turbine oils are thus desired that will enhance the fatigue life of gears in the wind turbines.

Lubricants in said speed-increasing units or gearboxes have to fulfil several different roles. They must work at higher operating loads while helping in reducing temperatures in the gearboxes. They need to avoid fatigue-related damages (e.g. pitting) and wear (adhesion, abrasion, polishing and scuffing) on the gears, while also remaining fitter-friendly (no leaks), non-foaming, water-resistant, and harmless to operators.

Also, inasmuch as lubricants in wind turbines gearboxes are often subjected to prolonged periods of use between any maintenance and service intervals, a long lasting lubricant stability is required, so as to provide outstanding service performance over lengthy durations of time.

Finally, wind turbines can be located all over the world, on mountain tops, off-shore or along coastlines, in deserts: in addition to longevity issues, said lubricants must also be able to withstand a variety of environmental conditions, including temperature extremes and moisture, in addition to being able to resist oxidation and prevent corrosion.

Lubricant compositions have already been proposed in the past, at least partially fulfilling above mentioned requirements.

Thus, US 2005090410 (ETHYL CORPORATION) 28 Apr. 2005 discloses lubricant compositions suitable as gear oils for wind turbine comprising an additive concentrate composed of extreme pressure additives, load capacity enhancers and friction modifying compounds to be used in combination with a base oil either from natural sources (hydrocarbon oils of lubricating viscosity derived from petroleum, tar sands, coal, shale, and so forth, as well as natural oils such as rapeseed oil) or synthetic (e.g. poly-[alpha]-olefin oils, hydrogenated polyolefins, alkylated aromatics, polybutenes, alkyl esters of dicarboxylic esters, complex esters of dicarboxylic esters, polyol esters, polyglycols, polyphenyl ethers, alkyl esters of carbonic or phosphoric acids, polysilicones, fluorohydrocarbon oils).

Also, ERRICHELLO, Robert, et al. Oil Cleanliness in Wind Turbine Gearboxes. *Machinery Lubrication Magazine*. July 2002. discloses lubricating wind mill gearboxes with ester-based lubricants and mineral oils with antiscuff additives.

Similarly, a recent press release from Kluber Lubrication GB, published on Engineeringtalk (www.engineeringtalk.com) on Dec. 6, 2006, has proposed synthetic gear oils for wind turbines based on polyalphaolefins, polyglycol or rapidly biodegradable esters.

Nevertheless, lubricating oils of the prior art fail to provide for high thermal resistance and resistance to oxidation and exhibit changes in viscosity at rising or falling temperature which are inappropriate for complying with both cold start-up and steady state operations of the gear box of a wind turbine.

In particular, the lubricant of the prior art undergo significant viscosity increase at low temperature and are characterized by pour points close to temperatures which can be at least occasionally encountered during a wind mill start-up either after a shutdown or idling or non-rotation after low or no-wind periods during the year.

Also, lubricants of the prior art possess hazardous flammability properties, so that their use, in particular at high temperatures as occasionally encountered in wind turbine gear boxes as a function of wind power and of outdoor temperature (e.g. in sunny summer times), might be dangerous or locally expose the material to temperatures higher than their flash point.

In addition, lubricants of the prior art, in view of their flash point, evaporation behaviour (risk of evaporative losses) and thermal stability, often represent the actual limiting element for setting upper operating temperature boundaries, requiring special actions and measures, other parts of the gear box assembly being designed to possibly withstand higher temperatures.

Finally, lubricants of the prior art are highly sensitive to contamination from aqueous pollutants, e.g. of brine or other moisturized contaminants. Actually, as well known in the art, lubricants contamination is a dangerous source of failures of gear boxes of wind turbines, and contamination from aqueous pollutants especially in off-shore wind turbine fields is quite recurrent. Now, lubricants of the prior art do not offer suitable intrinsic protection against aqueous pollutants and purification processes for removal of said pollutants are burdensome. Synthetic ester lubricants have generally poor hydrolytic stability, that is to say that in contact with water might deteriorate through split back into an alcohol and an organic acid, totally compromising lubricating properties. Polyalkyleneglycol (PAG) oils might even be water miscible, so that they can be used only where condensate or water ingress is minimal.

The need was thus felt to provide a method for lubricating gear boxes of a wind turbine wherein the lubricant offer a wider operating temperature window, increased thermal and oxidative stability, non-flammability behaviour and increased resistance to aqueous pollutants so as to enable extended service life, while still providing adequate friction coefficients, wear protection, scuff resistance and load capacity.

DISCLOSURE OF INVENTION

It is thus an object of the invention a method of lubricating a wind turbine gearbox comprising using a lubricating composition comprising at least one (i.e. one or a mixture of more than one) perfluoropolyether (PFPE) lubricant, i.e. a lubricant comprising a perfluorooxyalkylene chain, that is to say a chain comprising recurring units having at least one ether bond and at least one fluorocarbon moiety.

The Applicant has found that thanks to the use of the PFPE lubricant, wind turbines gearboxes can be efficiently operated with virtually no risk of failure, as the PFPE lubricant advantageously enable wider operating temperature window, including suitable performances for cold start-up, increased thermal and oxidative stability so as to enable extended service life, while still providing adequate friction coefficients, wear protection, scuff resistance and load capacity.

Also, PFPE lubricants are endowed with outstanding non-flammability behaviour, so that risks of ignition, fire or explosion are completely avoided.

Finally, PFPE lubricants easily undergo phase separation when contaminated by aqueous pollutants (e.g. brine), so that their purification from those contaminants by skimming is an easy task.

PFPE lubricants can be classified in oils and greases; it is generally understood that oils are compounds having kinematic viscosity (ASTM D445) at 40° C. of from 30 to 30 000 cSt; greases are derived from such oils by addition of suitable thickeners, such as notably polytetrafluoroethylene (PTFE) or inorganic compounds, e.g. talc.

Generally, the PFPE lubricant to be used in the present invention will have a kinematic viscosity in above mentioned conditions of 30 to 3 000 cSt, preferably from 50 to 500 cSt, when determined at 20° C. according to ASTM D445.

The lubricant composition generally comprises at least one PFPE oil selected from the following groups:

$$B—O—[CF(CF_3)CF_2O]_{b1'}(CFXO)_{b2'}B' \quad (1)$$

wherein:

X is equal to —F or —$CF_3$;

B and B', equal to or different from each other, are selected from —$CF_3$, —$C_2F_5$ or —$C_3F_7$;

b1' and b2', equal or different from each other, are independently integers 0 selected such that the b1'/b2' ratio is comprised between 20 and 1,000 and b1'+b2' is in the range 5 to 250; should b1' and b2' be both different from zero, the different recurring units are generally statistically distributed along the chain.

Said products can be obtained by photooxidation of the hexafluoropropylene as described in CA 786877 (MONTEDISON S.P.A.) 6 Apr. 1968, and by subsequent conversion of the end groups as described in GB 1226566 (MONTECATINI EDISON S.P.A.) 31 Mar. 1971.

$$C_3F_7O—[CF(CF_3)CF_2O]_{o'}-D \quad (2)$$

wherein

D is equal to —$C_2F_5$ or —$C_3F_7$;

o' is an integer from 5 to 250.

Said products can be prepared by ionic hexafluoropropylene epoxide oligomerization and subsequent treatment with fluorine as described in U.S. Pat. No. 3,242,218 (DU PONT) 22 Mar. 1966.

$$\{C_3F_7O—[CF(CF_3)CF_2O]_{dd'}—CF(CF_3)—\}_2 \quad (3)$$

wherein dd' is an integer between 2 and 250.

Said products can be obtained by ionic telomerization of the hexafluoropropylene epoxide and subsequent photochemical dimerization as reported in U.S. Pat. No. 3,214,478 (DU PONT) 26 Oct. 1965.

$$C'—O—[CF(CF_3)CF_2O]_{c1'}(C_2F_4O)_{c2'}(CFX)_{c3'}—C'' \quad (4)$$

wherein

X is equal to —F or —$CF_3$;

C' and C'', equal to or different from each other, are selected from —$CF_3$, —$C_2F_5$ or —$C_3F_7$;

c1', c2' and c3' equal or different from each other, are independently integers ≥0, such that and c1'+c2'+c3' is in the range 5 to 250; should at least two of c1', c2' and c3' be different from zero, the different recurring units are generally statistically distributed along the chain.

Said products can be manufactured by photooxidation of a mixture of $C_3F_6$ and $C_2F_4$ and subsequent treatment with fluorine as described in U.S. Pat. No. 3,665,041 (MONTEDISON S.P.A.) 23 May 1972.

$$D-O—(C_2F_4O)_{d1'}(CF_2O)_{d2'}D' \quad (5)$$

wherein

D and D', equal to or different from each other, are selected from —$CF_3$, —$C_2F_5$ or —$C_3F_7$;

d1' and d2' equal or different from each other, are independently integers ≥0, such that the d1'/d2' ratio is comprised between 0.1 and 5 and d1'+d2' is in the range 5 to 250; should d1' and d2' be both different from zero, the different recurring units are generally statistically distributed along the chain.

Said products can be produced by photooxidation of $C_2F_4$ as reported in U.S. Pat. No. 3,715,378 (MONTEDISON S.P.A.) 6 Feb. 1973 and subsequent treatment with fluorine as described in U.S. Pat. No. 3,665,041 (MONTEDISON S.P.A.) 23 May 1972.

$$G-O—(CF_2CF_2C(Hal')_2O)_{g1'}—(CF_2CF_2CH_2O)_{g2'}—(CF_2CF_2(Hal')O)_{g3'}-G' \quad (6)$$

wherein

G and G', equal to or different from each other, are selected from $—CF_3$, $—C_2F_5$ or $—C_3F_7$;

Hal', equal or different at each occurrence, is a halogen chosen among F and Cl, preferably F;

g1', g2', and g'3 equal or different from each other, are independently integers ≥0, such that g1'+g2'+g3' is in the range 5 to 250; should at least two of g1', g2' and g3' be different from zero, the different recurring units are generally statistically distributed along the chain.

Said products may be prepared by ring-opening polymerizing 2,2,3,3-tetrafluorooxethane in the presence of a polymerization initiator to give a polyether comprising repeating units of the formula: $—CH_2CF_2CF_2O—$, and optionally fluorinating and/or chlorinating said polyether, as detailed in EP 148482 A (DAIKIN INDUSTRIES) 17 Jul. 1985.

$$L\text{-}O—(CF_2CF_2O)_{l'}\text{-}L' \quad (7)$$

wherein

L and L', equal to or different from each other, are selected from $—C_2F_5$ or $—C_3F_7$;

l' is an integer in the range 5 to 250.

Said products can be obtained by a method comprising fluorinating a polyethyleneoxide, e.g. with elemental fluorine, and optionally thermally fragmentating the so-obtained fluorinated polyethyleneoxide as reported in U.S. Pat. No. 4,523,039 (THE UNIVERSITY OF TEXAS) 11 Jun. 1985.

$$R^1_f—\{C(CF_3)_2—O—[C(R^2_f)_2]_{kk1'}C(R^2_f)_2—O\}_{kk2'}—R^1_f \quad (8)$$

wherein $R^1_f$ is a perfluoroalkyl group having from 1 to 6 carbon atoms;

$R^2_f$ is equal to —F or perfluoroalkyl group having from 1 to 6 carbon atoms;

kk1' is an integer from 1 to 2;

kk2' represents a number in the range 5 to 250.

Said products can be produced by the copolymerization of hexafluoroacetone with an oxygen-containing cyclic comonomer selected from ethylene oxide, propylene oxide, epoxy-butane and/or trimethylene oxide (oxethane) or substituted derivatives thereof and subsequent perfluorination of the resulting copolymer, as detailed in patent application WO 87/00538 (LAGOW ET AL.) 29 Jan. 1987.

Preferred lubricating compositions suitable for the purposes of the invention are those comprising notably:

lubricants commercially available under the trade name FOMBLIN® (type Y, M, W, or Z) from Solvay Solexis, S.p.A.; lubricants of this family generally comprise at least one oil (i.e. only one or mixture of more than one oil) complying with either of formulae here below:

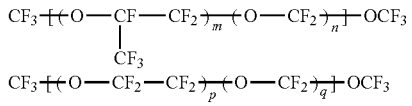

m + n = 8-45: m/n = 20-10 000
p + q = 40-180; p/q = 0.1-10 lubricants commercially available under the trade name KRYTOX® from Du Pont de Nemours, said lubricants generally comprising at least one (i.e. one or mixtures of more than one) low-molecular weight, fluorine end-capped, homopolymer of hexafluoropropylene epoxide with the following chemical structure:

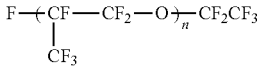

n = 10 to 60 lubricants commercially available under the trade name DEMNUM® from Daikin, said lubricants generally comprising at least one (i.e. one or mixture of more than one) oil complying with formula:

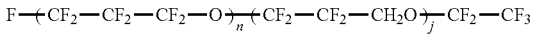

j = 0 or integer > 0; n + j = 10 to 150

More preferred PFPE lubricants are those commercially available under the trade name FOMBLIN®, as above detailed.

More specifically, most preferred PFPE lubricants are those complying with formula here below:

$$D^*—O—(C_2F_4O)_{d1^*}(CF_2O)_{d2^*}\text{-}D^{*'}$$

wherein

D* and D*', equal to or different from each other, are selected from $—CF_3$, $—C_2F_5$ or $—C_3F_7$;

d1* and d2* equal or different from each other, are independently integers ≥0, such that the d1*/d2* ratio is comprised between 0.1 and 5 and d1*+d2* is in the range 5 to 250; should d1* and d2* be both different from zero, the different recurring units are generally statistically distributed along the chain.

According to a preferred embodiment of the invention, the lubricating composition used in the process of the invention advantageously further comprises at least one cyclic phosphazene compound comprising one or more cyclic moiety of formula:

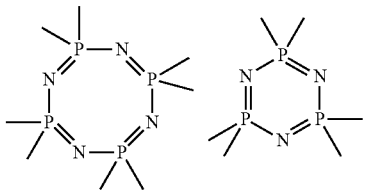

having bound to one or more phosphorus atom(s) at least one substituent comprising a (per)fluoroalkyloxychain.

The Applicant has surprisingly found that the addition of said cyclic phosphazene compound as additives in the lubricating composition advantageously enables improvement both of the anti-rust and anti-wear properties of the lubricating composition.

Particularly useful cyclic phosphazene compounds are those described in EP 1336614 A (SOLVAY SOLEXIS S.P.A.) 20 Aug. 2003 or in MACCONE, P, et al. New additives for fluorinated lubricants. 70*th NLGI Annual Meeting, Hilton Head Island, South carolina* (*Oct.* 25-29, 2003). no. #318. having bound to all the phosphorus atoms substituents comprising (per)fluoroalkyloxychains having a number averaged molecular weight in the range 280-5000 and end groups of the $—OCF_2X$, $—OC_2F_4X$, $—OC_3F_6X$ type, wherein X=F, Cl, H, e.g. complying with formula here below:

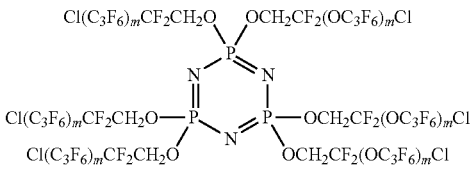

with m being an integer such that the averaged molecular weight is in above mentioned range.

wherein M' is a divalent metal, preferably an alkaline earth metal selected from Ca, and Mg [group (P)];

$n_Z$ is an integer from 1 to 3, preferably equal to 1;

$n_Z$ is an integer from 1 to 4, preferably equal to 1;

$n_{f'}$ is an integer such that $n_Z+n_{f'}$ is equal to 8;

$n_f$ is an integer such that $n_Z+n_f$ is equal to 6, a detailed description thereof being notably available in WO 2008/000706 (SOLVAY SOLEXIS S.P.A.) 3 Jan. 2008.

In this class of cyclic phosphazene compounds comprising a group (P), preferred compounds comply with formula (V) or (V-bis) here below:

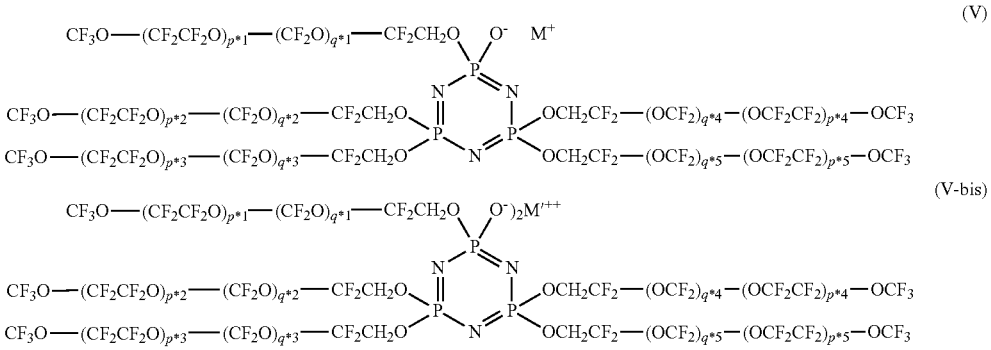

Another class of cyclic phosphazene compounds which have been found particularly advantageous in the process of the invention are those complying with formula (I) or (II) here below:

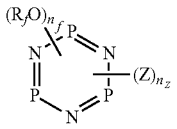

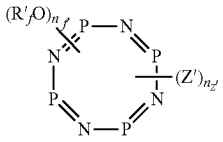

wherein:

$R_f$ and $R'_{f'}$ equal or different each other and at each occurrence, represent independently, a (per)fluoropolyoxyalkylene chain [chain (OF)] comprising (preferably consisting essentially of) recurring units R°, said recurring units, distributed randomly through the (per)fluoropolyoxyalkylene chain, being chosen among:

(i) —CFXO—, wherein X is F or $CF_3$, (ii) —$CF_2CFXO$—, wherein X is F or $CF_3$, (iii) —$CF_2CF_2CF_2O$—, (iv) —$CF_2CF_2CF_2CF_2O$—

Z and Z', equal or different each other and at each occurrence, represent a polar group of formula —$O^-M^+$, wherein M is chosen among hydrogen, a monovalent metal, preferably an alkaline metal selected from Li, Na, K, an ammonium radical of formula $NR_1R_2R_3R_4$, wherein each of $R_1$, $R_2$, $R_3$, $R_4$ is, independently, an hydrogen atom or a $C_1$-$C_{12}$ hydrocarbon group, optionally fluorinated, or a polar group of formula —$O^-)_2M'^{2+}$, wherein:

M and M' have the same meaning as above defined, preferably M is an alkaline metal selected from Li, Na, K or an ammonium radical of formula $NR_1R_2R_3R_4$, wherein each of $R_1$, $R_2$, $R_3$, $R_4$ is, independently, an hydrogen atom or a $C_1$-$C_{12}$ hydrocarbon group, preferably $R_1$=$R_2$=$R_3$=$R_4$=n-butyl, and preferably M' is an alkaline earth metal selected from Ca, Mg, more preferably M' is Ca;

each of p*i (i=1 to 5) and q*i (i=1 to 5) is independently an integer ≥0 such that p*i+q*i is in the range 2-25 and the q*i/p*i ratio is comprised between 0.1 and 10.

Typically, the lubricating composition will comprise the cyclic phosphazene compound in an amount of advantageously at least 0.5% wt, preferably at least 1% wt, more preferably of at least 2% wt with respect to the weight of the PFPE lubricant and of the cyclic phosphazene compound.

Also, the lubricating composition will comprise the cyclic phosphazene compound in an amount of advantageously at most 15% wt, preferably at most 10% wt, more preferably of at most 5% wt with respect to the weight of the PFPE lubricant and of the cyclic phosphazene compound.

The lubricating composition can also further comprises other additives including notably one of more of rust inhibitors, oxidation inhibitors, antifoam agents; anti-wear additives, anti-scuff additives and extreme pressure additives.

Still another object of the invention is a wind turbine gearbox comprising a lubricating system containing a lubricating composition comprising at least one PFPE lubricant as above described.

The lubricating system can be designed to provide so-called splash lubrication, pressure fed lubrication or a combination of the previous systems.

In the splash lubrication system, low speed gear dips into an oil bath for generally at least twice the tooth depth to provide adequate splash for gears and bearings. Generally the gear housing is provided with troughs to capture the lubricant flowing down the housing walls, and channels to the bearings.

Offline filtration systems are generally employed for maintaining required lubricant cleanliness.

In the pressure fed lubricating system, gearbox elements are lubricated by feeding to rotating elements lubricant through an oil circulation system comprising suitable spray nozzles, recovery means (e.g. a receiving tank) and pumping means. The lubricant circulation system can be further equipped with inline or offline filters and/or suitable heat exchangers, in particular for cooling the lubricant.

Combined lubrication systems utilize both splash and pressure fed lubrication methods to ensure adequate lubricant is available to gears and bearings on all shafts. Oil filters and heat exchangers may be still integrated in this system.

The invention will be now illustrated in more detail by reference to the following examples whose purpose is merely illustrative and not limiting the scope of the present invention.

The table 1 here below summarizes comparison between selected prior art lubricants, currently used for wind turbines gear boxes lubrication and PFPE lubricants.

In table 1 here below:

"Viscosity" stands for the kinematic viscosity of the fluid in cSt, as measured according to ASTM D455 standard at 40° C.;

"viscosity index", measured according to ASTM D2270 is a number that indicates the effect of temperature changes on the viscosity of the lubricant, lower values corresponding to relatively large change of viscosity with changes of temperature and higher values relatively little change in viscosity over a wide temperature range;

pour point, determined according to ASTM D97, is an index of the lowest temperature of handleability/use of the lubricant;

the flash point, determined according to ASTM D92, represents the minimum temperature at which the lubricant produces a sufficient concentration of vapour above it that it forms an ignitable mixture with air; it is thus an indication of the flammability of the lubricant.

Mineral Oils OMALA® 220, 320 and 460 are synthetic oils commercially available from Shell.

MOBILGEAR® SHC XMP is a polyalphaolefin (PAO) lubricant commercially available from MOBIL.

KLÜBERSYNTH® GEM 4-320 N is a polyalphaolefin (PAO) lubricant commercially available from Klüber.

KLÜBERSYNTH® GH 6-320 is a polyglycol-type (PAG) lubricant commercially available from Klüber.

KLÜBERSYNTH® GEM 2-320 is an ester-type lubricant commercially available from Klüber.

KRYTOX® GPL106 is a PFPE lubricant commercially available from DuPont de Nemours.

DEMNUM® S 100 and 200 are PFPE lubricants commercially available from Daikin Industries.

PFPE FOMBLIN® M30 is a PFPE lubricant commercially available from Solvay Solexis complying with formula here below:

$$CF_3—O—(C_2F_4O)_p—(CF_2O)_q—CF_3$$

wherein the p/q ratio ranges from 0.75 to 1.1, having an average molecular weight of about 9 800 and a kinematic viscosity of about 159 cSt at 40° C.

MOLYKOTE® L-8200 is a PFPE lubricant mixture available from Dow Corning comprising lubricant FOMBLIN® M30 as above detailed and 3% wt of a phosphazene additive of formula:

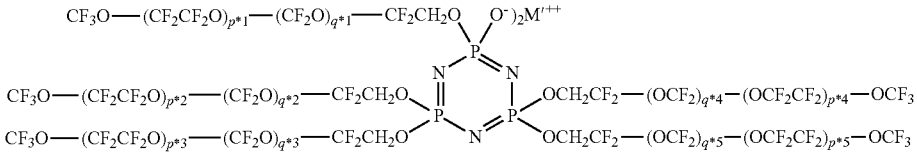

wherein $M^{++}$ is alkaline earth metal ion $Ca^{2+}$ and each of p*i (i=1 to 5) and q*i (i=1 to 5) is an integer such that the q*i/p*i ratio is comprised between 0.1 and 10 and the average molecular weight is 3 400.

TABLE 1

| Oils/Properties | Viscosity at 40° C. | Viscosity Index | Pour Point | Flash Point |
|---|---|---|---|---|
| Mineral Oil OMALA ® 220 | 220 | 100 | −18 | 200 |
| Mineral Oil OMALA ® 320 | 320 | 100 | −15 | 205 |
| Mineral Oil OMALA ® 460 | 460 | 97 | −12 | 205 |
| MOBILGEAR ® SHC XMP 460 | 460 | 168 | −36 | 232 |
| KLÜBERSYNTH ® GEM 4-320 N | 320 | 150 | −35 | n.d. |
| KLÜBERSYNTH ® GH 6-320 | 320 | >230 | −30 | >280 |
| KLÜBERSYNTH ® GEM 2-320 | 320 | 150 | −30 | 270 |
| PFPE KRYTOX ® GPL106 | 240 | 134 | −36 | none |
| PFPE DEMNUM ® S100 | 100 | 200 | −60 | none |
| PFPE DEMNUM ® S200 | 200 | 210 | −53 | none |
| PFPE FOMBLIN ® M30 | 159 | 338 | −65 | none |
| MOLYKOTE ® L-8200 | 158 | 339 | −59 | none |

The table here above shows that PFPE lubricants possess best compromise between viscosity behaviour (high viscosity indexes), pour point and flammability properties.

Lubricants as above described were submitted to gearbox lubricating properties evaluation following ISO14635 standard for the determination of scuffing load-carrying capacity and wear characteristics. Results summarized in table 2 here below well demonstrate that PFPE lubricants possess suitable lubricating behaviour for being used in wind turbine gear boxes.

TABLE 2

| Oils/Properties | Lubricating Behaviour via FZG test | |
|---|---|---|
| Mineral Oil OMALA ® 220 | load stage: >12 | micropitting: 10 |
| Mineral Oil OMALA ® 320 | load stage: >12 | micropitting: 10 |

TABLE 2-continued

| Oils/Properties | Lubricating Behaviour via FZG test | |
|---|---|---|
| Mineral Oil OMALA ® 460 | load stage: >12 | micropitting: 10 |
| KLÜBERSYNTH ® GEM 4-320 N | load stage: >13 | n.d. |
| KLÜBERSYNTH ® GH 6-320 | load stage: >13 | n.d. |
| KLÜBERSYNTH ® GEM 2-320 | load stage: >13 | n.d. |
| PFPE FOMBLIN ® M30 | load stage: >10 | n.d. |
| MOLYKOTE ® L-8200 | load stage: >10 | micropitting: >10 |

Also, thermo-oxidative stability of a selection of lubricants were performed according to Pressured Differential Scanning calorimetry (PDSC) following ASTM D6186 standard, at 175° C., with an $O_2$ pressure of 3500 kPa. Table 3 here below summarizes induction time to oxidation in above mentioned conditions, the higher this value, the better being the thermo-oxidative stability.

TABLE 3

| Lubricant type | Oxidation induction time |
|---|---|
| Polyalphaolefin lubricant | 18 minutes |
| Ester lubricant | 15 minutes |
| MOLYKOTE ® L-8200 | >24 hours |

As well shown in Table 3, only PFPE lubricants can provide suitable thermo-oxidative resistance, making them suitable for being used in wind turbine gear boxes and enabling significantly increased service life.

The invention claimed is:

1. A method of lubricating a wind turbine gearbox comprising using a lubricating composition consisting essentially of at least one perfluoropolyether (PFPE) lubricant having a perfluorooxyalkylene chain, said perfluorooxyalkylene chain containing recurring units having at least one ether bond and at least one fluorocarbon moiety.

2. The method of claim 1, wherein the PFPE lubricant has a kinematic viscosity in above mentioned conditions of 30 to 3,000 cSt, when determined at 40° C. according to ASTM D445.

3. The method of claim 1, wherein the lubricating composition comprises at least one PFPE oil selected from the group consisting of:

$$B—O—[CF(CF_3)CF_2O]_{b1'}(CFXO)_{b2'}B' \quad (1)$$

wherein:

X is equal to —F or —$CF_3$;

B and B', equal to or different from each other, are selected from the group consisting of —$CF_3$, —$C_2F_5$, and —$C_3F_7$;

b1' and b2', equal to or different from each other, are independently integers ≥0 selected such that the b1'/b2' ratio is comprised between 20 and 1,000 and b1'+b2' is in the range 5 to 250;

$$C_3F_7O—[CF(CF_3)CF_2O]_{o'}-D \quad (2)$$

wherein

D is equal to —$C_2F_5$ or —$C_3F_7$;

o' is an integer from 5 to 250;

$$\{C_3F_7O—[CF(CF_3)CF_2O]_{dd'}—CF(CF_3)—\}_2 \quad (3)$$

wherein dd' is an integer between 2 and 250;

$$C'—O—[CF(CF_3)CF_2O]_{c1'}(C_2F_4O)_{c2'}(CFX)_{c3'}—C'' \quad (4)$$

wherein

X is equal to —F or —$CF_3$;

C' and C'', equal to or different from each other, are selected from the group consisting of —$CF_3$, —$C_2F_5$, and —$C_3F_7$;

c1', c2' and c3' equal to or different from each other, are independently integers ≥0, such that and c1'+c2'+c3' is in the range 5 to 250;

$$D\text{-}O—(C_2F_4O)_{d1'}(CF_2O)_{d2'}D' \quad (5)$$

wherein

D and D', equal to or different from each other, are selected from the group consisting of —$CF_3$, —$C_2F_5$, and —$C_3F_7$;

d1' and d2' equal to or different from each other, are independently integers ≥0, such that the d1'/d2' ratio is comprised between 0.1 and 5 and d1'+d2' is in the range 5 to 250;

$$G\text{-}O—(CF_2CF_2C(Hal')_2O)_{g1'}—(CF_2CF_2CH_2O)_{g2'}—(CF_2CF_2(Hal')O)_{g3'}\text{-}G' \quad (6)$$

wherein

G and G', equal to or different from each other, are selected from the group consisting of —$CF_3$, —$C_2F_5$, and —$C_3F_7$;

Hal', equal to or different at each occurrence, is a halogen selected from the group consisting of F and Cl;

g1', g2', and g'3, equal to or different from each other, are independently integers ≥0, such that g1'+g2'+g3' is in the range 5 to 250;

$$L\text{-}O—(CF_2CF_2O)_{l'}\text{-}L' \quad (7)$$

wherein

L and L', equal to or different from each other, are selected from —$C_2F_5$ or —$C_3F_7$;

l' is an integer in the range 5 to 250; and $$R^1_f—\{C(CF_3)_2—O—[C(R^2_f)_2]_{kk1'}C(R^2_f)_2—O\}_{kk2'}—R^1_f \quad (8)$$

wherein $R_f$ is a perfluoroalkyl group having from 1 to 6 carbon atoms;

$R^2_f$ is equal to —F or perfluoroalkyl group having from 1 to 6 carbon atoms;

kk1' is an integer from 1 to 2;

kk2' represents a number in the range 5 to 250.

4. The method of claim 3, wherein the lubricating composition comprises at least one PFPE oil selected from those complying with formula here below:

$$D^*—O—(C_2F_4O)_{d1^*}(CF_2O)_{d2^*}\text{-}D^{*'}$$

wherein

D* and D*', equal to or different from each other, are selected from the group consisting of —$CF_3$, —$C_2F_5$, and —$C_3F_7$;

d1* and d2* equal to or different from each other, are independently integers ≥0, such that the d1*/d2* ratio is comprised between 0.1 and 5 and d1*+d2* is in the range 5 to 250.

5. A method of lubricating a wind turbine gearbox comprising using a lubricating composition comprising at least one perfluoropolyether (PFPE) lubricant comprising a perfluorooxyalkylene chain, said perfluorooxyalkylene chain comprising recurring units having at least one ether bond and at least one fluorocarbon moiety, and at least one cyclic phosphazene compound comprising one or more cyclic moiety of formula:

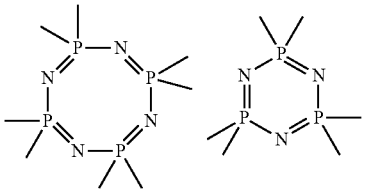

having bound to one or more phosphorus atom(s) at least one substituent comprising a (per)fluoroalkyloxychain.

6. The method of claim 5, wherein the cyclic phosphazene compound complies with formula here below:

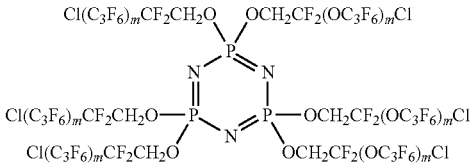

with m being an integer such that the averaged molecular weight is in the range 280-5000.

wherein:

$R_f$ and $R'_f$, equal to or different from each other and at each occurrence, represent independently, a (per)fluoropolyoxyalkylene chain [chain (OF)] comprising recurring units R°, said recurring units R°, distributed randomly through the (per)fluoropolyoxyalkylene chain, being selected from the group consisting of:

(i) —CFXO—, wherein X is F or $CF_3$, (ii) —$CF_2CFXO$—, wherein X is F or $CF_3$, (iii) —$CF_2CF_2CF_2O$—, and (iv) —$CF_2CF_2CF_2CF_2O$—

Z and Z', equal to or different from each other and at each occurrence, represent a polar group of formula —$O^-M^+$, wherein M is selected from the group consisting of hydrogen; a monovalent metal; and an ammonium radical of formula $NR_1R_2R_3R_4$, wherein each of $R_1$, $R_2$, $R_3$, $R_4$ is, independently, an hydrogen atom or a $C_1$-$C_{12}$ hydrocarbon group, optionally fluorinated; or represent a polar group of formula —$O^-)_2M'^{2+}$, wherein M' is a divalent metal [group (P)];

$n_Z$ is an integer from 1 to 3;

$n_{Z'}$ is an integer from 1 to 4;

$n_{f'}$ is an integer such that $n_Z+n_{f'}$ is equal to 8;

$n_f$ is an integer such that $n_Z+n_f$ is equal to 6.

8. The method of claim 7, wherein the cyclic phosphazene compound complies with formula (V) or (V-bis) here below:

(V)

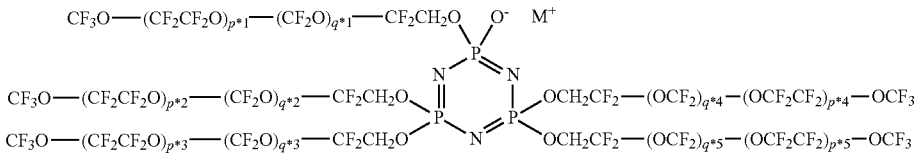

(V-bis)

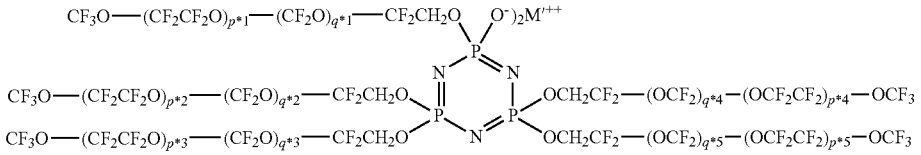

7. The method of claim 5, wherein the cyclic phosphazene compound complies with formula (I) or (II) here below:

(I)

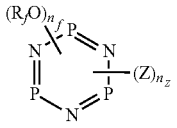

(II)

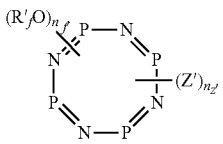

wherein:

M and M' have the same meaning as in claim 7 each of p*i (i=1 to 5) and q*i (i=1 to 5) is independently an integer ≥0 such that p*i+q*i is in the range 2-25 and the q*i/p*i ratio is comprised between 0.1 and 10.

9. The method according to claim 5, wherein the lubricating composition comprises the cyclic phosphazene compound in an amount of advantageously at least 0.5% wt and at most 15% wt, with respect to the weight of the PFPE lubricant and of the cyclic phosphazene compound.

* * * * *